US009280941B2

(12) United States Patent
Kang et al.

(10) Patent No.: US 9,280,941 B2
(45) Date of Patent: Mar. 8, 2016

(54) LIQUID CRYSTAL DISPLAY DEVICE WITH DIRECT TYPE BACKLIGHT AND METHOD OF DRIVING THEREOF

(71) Applicant: LG Display Co., Ltd., Seoul (KR)

(72) Inventors: TaeUk Kang, Gyeonggi-Do (KR); SungYong Park, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 302 days.

(21) Appl. No.: 13/833,583

(22) Filed: Mar. 15, 2013

(65) Prior Publication Data

US 2013/0241976 A1 Sep. 19, 2013

(30) Foreign Application Priority Data

Mar. 16, 2012 (KR) ..... 10-2012-0027368

(51) Int. Cl.
*G09G 3/36* (2006.01)
*G09G 3/34* (2006.01)

(52) U.S. Cl.
CPC ..... *G09G 3/3611* (2013.01); *G09G 3/3426* (2013.01); *G09G 3/3648* (2013.01); *G09G 3/342* (2013.01); *G09G 2320/0233* (2013.01); *G09G 2320/064* (2013.01); *G09G 2360/141* (2013.01)

(58) Field of Classification Search
CPC ..... G09G 3/342; G09G 2360/141; G09G 2320/064
USPC ..... 345/102, 690
See application file for complete search history.

(56) References Cited

U.S. PATENT DOCUMENTS

| | | | | |
|---|---|---|---|---|
| 8,253,682 | B2 * | 8/2012 | Feng | 345/102 |
| 2006/0268574 | A1 | 11/2006 | Jung et al. | |
| 2007/0229446 | A1 * | 10/2007 | Oh et al. | 345/102 |
| 2010/0123743 | A1 * | 5/2010 | Chang et al. | 345/690 |
| 2010/0141672 | A1 * | 6/2010 | Kang et al. | 345/589 |
| 2011/0096101 | A1 * | 4/2011 | Lee et al. | 345/690 |
| 2011/0241980 | A1 | 10/2011 | Lee et al. | |
| 2012/0001946 | A1 | 1/2012 | Cho et al. | |
| 2012/0075274 | A1 * | 3/2012 | Ueno et al. | 345/207 |
| 2012/0081407 | A1 * | 4/2012 | Chiou et al. | 345/690 |

FOREIGN PATENT DOCUMENTS

| | | | | |
|---|---|---|---|---|
| CN | 1873504 | A | 12/2006 | |
| CN | 101839423 | A | 9/2010 | |
| CN | 102235624 | A | 11/2011 | |
| CN | 102314841 | A | 1/2012 | |
| JP | WO2010146735 | A1 * | 12/2010 | G09G 3/36 |
| KR | 10-2008-0062848 | | 7/2008 | |

OTHER PUBLICATIONS

Chinese Office Action dated Oct. 23, 2014, for corresponding Chinese Application No. 201310082997.5.
Korean Office Action issued in corresponding Korean Patent Application No. 10-2012-0027368 dated May 29, 2013.

* cited by examiner

*Primary Examiner* — Chanh Nguyen
*Assistant Examiner* — Yuzhen Shen
(74) *Attorney, Agent, or Firm* — Morgan, Lewis & Bockius LLP

(57) ABSTRACT

A direct type liquid crystal display device according to an embodiment of the present disclosure may enhance the brightness uniformity.

17 Claims, 8 Drawing Sheets

| | 1p | 2p | 3p | 4p | 5p | 6p | 7p | 8p | 9p | 10p | 11p | 12p | 13p | BRIGHTNESS UNIFORMITY |
|---|---|---|---|---|---|---|---|---|---|---|---|---|---|---|
| BRIGHTNESS IN THE RELATED ART (nit) | 885 | 860 | 880 | 893 | 874 | 895 | 872 | 862 | 881 | 780 | 799 | 820 | 802 | 1.15 |
| BRIGHTNESS IN THE FIRST EMBODIMENT (nit) | 835 | 829 | 829 | 847 | 825 | 846 | 837 | 834 | 845 | 800 | 810 | 830 | 820 | 1.05 |

LIQUID CRYSTAL DISPLAY DEVICE WITH DIRECT TYPE BACKLIGHT AND METHOD OF DRIVING THEREOF

CROSS-REFERENCE TO RELATED APPLICATIONS

This application claims the benefit of Korean Patent Application No. 10-2012-0027368, filed on Mar. 16, 2012, which is hereby incorporated by reference for all purposes as if fully set forth herein.

BACKGROUND OF THE INVENTION

1. Field of the Invention

The present invention relates to a direct type liquid crystal display device and a method of driving the same, and more particularly, to an invention for enhancing the brightness uniformity of the direct type liquid crystal display device.

2. Description of the Related Art

A liquid crystal display device is a display device having advantages such as compactness, light weight and low power consumption, and used for a wall mounted television as well as a monitor of the computer, and the demand has been continuously increased.

Such a liquid crystal display device is a light receiving device for controlling the amount of light received from the outside to display an image, and thus requires a separate light source.

Here, the liquid crystal display device may be divided into an edge type and a direct type.

Of them, the direct type liquid crystal display device has high light use rate and easy handling characteristics and does not have a limit in the size of the display surface, and thus has been widely used for large-sized liquid crystal display devices with a size of more than 30 inches.

For the light source of the direct type backlight assembly, cold cathode fluorescent lamp (CCFL) and external electrode fluorescent lamp (EEFL) are mainly used for the light source of the direct type backlight assembly, but in recent years, light emitting diodes have been also increasingly used.

Hereinafter, a liquid crystal display device according to the related art will be described with reference to the drawing.

FIG. 1 is a cross-sectional view illustrating a direct type liquid crystal display device according to the related art.

The liquid crystal display device is largely divided into a liquid crystal panel 10, a backlight unit (not shown), and a driving circuit unit (not shown).

The liquid crystal panel 10 displays an image on a front surface thereof, and the backlight unit (not shown) performs the role of emitting light, and the driving circuit unit performs the role of driving the backlight unit (not shown) and liquid crystal panel 10. In this case, an upper surface edge of the liquid crystal panel 10 is protected by a top cover (not shown), and the liquid crystal panel 10 is supported by a guide panel 30 disposed at the edge, and the backlight unit is protected by a cover bottom 40 at a lower side.

Here, the backlight unit may include light-emitting diodes (LEDs) 21, a printed circuit board (PCB) 22, a reflective plate 23, and a plurality of optical sheets 24.

The LEDs 21 emit light as a semiconductor emission element. Furthermore, the printed circuit board 22 is accommodated into an upper surface of the cover bottom 40 to operate the LEDs 21, and wiring for driving the LEDs 21 is disposed at a front surface thereof. At this time, the LEDs 21 are disposed at a front surface of the printed circuit board 22 to emit light toward the front.

However, the emission direction of the LEDs 21 may be irregular to emit light to the lateral surface thereof, and reflected within the cover bottom 40, thus generating light which is not directed toward the front disposed with the liquid crystal panel 10.

Accordingly, the reflective plate 23 is disposed at an upper surface of the printed circuit board 22 to reflect the light and scan it to the liquid crystal panel 10. The reflective plate 23 may include an opening area for disposing the LEDs 21, and thus may be fastened to the printed circuit board 22 in such a way that it is placed from an upper surface of the printed circuit board 22 mounted with the LEDs 21 to a lower surface thereof.

Furthermore, the plurality of optical sheets 24 diffuse and condense light directed from the LEDs 21 to the liquid crystal panel 10 to enhance and equalized the illumination. The optical sheets 24 may be comprised of a diffuser sheet, a prism sheet, a protector sheet, and the like.

On the other hand, the liquid crystal display device may vary the brightness of the backlight according to the user's input. In this case, a control signal may be received at the backlight driving unit for driving the backlight by an external signal according to the user's input, and the control signal collectively controls all the LEDs 21 to change the brightness.

However, light directed toward a side wall surface of the cover bottom 40 among the light emitted from the LEDs 21 disposed at the edge may be absorbed into the cover bottom 40. For example, the LEDs 21 disposed at the outer edge in FIG. 1 may include light ①, and the light ① may be absorbed toward the cover bottom 40. However, the LEDs 21 disposed at the central portion may include the form of light ②, and almost all light is incident to the front diffuser sheet.

Accordingly, almost all light emitted from the LEDs 21 disposed at the central portion of the backlight is transmitted toward the front whereas part of the light emitted from the LEDs 21 disposed at the outer edge is transmitted toward the front, and thus the brightness of the backlight may be not uniform over the entire region. In other words, it is observed that the brightness of the backlight in the outer region is lower than that in the central region.

As a result, brightness uniformity in the liquid crystal display device may be deteriorated, and since the brightness uniformity is one of key factors in determining quality, such deterioration of uniformity characteristics may not allow the user to view clear and uniform images.

SUMMARY OF THE INVENTION

Accordingly, in order to solve the foregoing problems, according to the embodiments of the present disclosure, an object of the present disclosure is to provide a liquid crystal display device in which at least one of duty ratio and current level that drives the outer light emitting elements and central light emitting elements is configured in a different manner, thereby allowing the liquid crystal display device to have uniform brightness.

In order to accomplish the foregoing objective, there is provided a direct type liquid crystal display device including a liquid crystal panel configured to display an image; a direct type backlight comprises a plurality of light emitting elements, which are divided into central light emitting elements and outer light emitting elements surrounding the central light emitting elements; a timing controller configured to receive an external signal entered by the user to generate a control signal for controlling the plurality of light emitting elements; and a backlight driving circuit configured to generate a first light emission signal for driving the outer light emitting elements and a second light emission signal for driving the central light emitting elements according to the control signal, wherein at least one of the duty ratio and current level of the first light emission signal is configured to be greater than the corresponding duty ratio or current level of the second light emission signal.

Preferably, the liquid crystal display device may be characterized in that the duty ratio of the control signal varies based on the external signal.

Furthermore, the liquid crystal display device may be characterized in that the backlight driving circuit determines a duty ratio of the first and the second light emission signal based on the duty ratio of the control signal.

Furthermore, the liquid crystal display device may be characterized in that the backlight driving circuit determines a current level of the first and the second light emission signal through a preset value.

Furthermore, the liquid crystal display device may be characterized in that the backlight driving circuit includes a first light emission control unit for generating the first light emission signal having the same duty ratio as that of the control signal and having a first current level and a second light emission control unit for generating the second light emission signal having a duty ratio less than that of the control signal and having a current level less than the first current level.

Furthermore, the liquid crystal display device may be characterized in that the first and the second light emission control unit control the on/off of a switching element connected to the light emitting element to adjust a duty ratio of the light emission signal.

Furthermore, the liquid crystal display device may be characterized in that the first and the second light emission control unit includes a DC/DC converter connected to an end of the plurality of light emitting elements to output a light emission signal having a specific level of voltage, a switching element connected to the other end of the plurality of light emitting elements, a resistor connected between the switching element and the ground terminal, a light emitting element driving unit configured to control the on/off of the switching element to adjust a duty ratio of the light emission signal and control the DC/DC converter to adjust a voltage of the light emission signal, and a drive controller configured to receive the control signal to control the operation of the light emitting element driving unit.

Furthermore, the liquid crystal display device may be characterized in that the duty ratio of the light emission signal is set to a different value for each light emitting element.

Furthermore, the liquid crystal display device may be characterized in that the current level of the light emission signal is set to the same value for a plurality of light emitting elements.

Furthermore, the liquid crystal display device may be characterized in that the plurality of light emitting elements are defined as a plurality of blocks containing at least one light emitting element for each block, and driven in the unit of block.

Furthermore, the liquid crystal display device may be characterized in that the first and the second light emission signal, respectively, include a plurality of signals, and the plurality of signals are applied to reduce at least one of the duty ratio or current level of the plurality of signals as located from the outer light emitting elements of the direct type backlight to the central light emitting elements thereof.

Furthermore, the liquid crystal display device may be characterized in that a light emitting element region to which the plurality of light emission signals are applied is defined as a rim shape surrounding light emitting elements disposed at a central portion of the direct type backlight.

On the other hand, according to another embodiment, there is provided a method of driving a direct type liquid crystal display device including a liquid crystal panel configured to display an image and a direct type backlight containing a plurality of light emitting elements, which are divided into central light emitting elements and outer light emitting elements surrounding the central light emitting elements, and the method may include receiving an external signal based on the user's input to generate a control signal having a specific duty ratio; generating a first and a second light emission signal a duty ratio of which is set according to the control signal and a current level of which is set according to a preset value; and applying the first light emission signal to outer light emitting elements and applying the second light emission signal to central light emitting elements, wherein at least one of the duty ratio and current level of the first light emission signal is configured to be greater than the corresponding duty ratio or current level of the second light emission signal.

Preferably, the method may be characterized in that said generating a first and a second light emission signal allows the duty ratio of the first light emission signal to be the same as the duty ratio of the control signal, and allows the duty ratio of the second light emission signal to be less than the duty ratio of the control signal.

Furthermore, the method may be characterized in that said generating a first and a second light emission signal allows the current level of the first light emission signal to be greater than the current level of the second light emission signal.

Furthermore, the method may be characterized in that said generating a first and a second light emission signal controls the on/off of a switching element connected to the light emitting element to adjust a duty ratio of the first and the second light emission signal.

Furthermore, the method may be characterized in that the duty ratio of the control signal varies based on the external signal.

Furthermore, the method may be characterized in that the first and the second light emission signal, respectively, include a plurality of signals, and the plurality of signals are applied to reduce at least one of the duty ratio or current level of the plurality of signals as located from the outer light emitting elements of the direct type backlight to the central light emitting elements thereof.

Furthermore, the method may be characterized in that a light emitting element region to which the plurality of light emission signals are applied is defined as a rim shape surrounding light emitting elements disposed at a central portion of the direct type backlight.

According to a direct type liquid crystal display device and a driving method thereof having the foregoing configuration associated with at least one embodiment of the present disclosure, at least one of the duty ratio and current level of a light emission signal applied to outer light emitting elements may be configured to be greater than the duty ratio or current level of the light emission signal applied to central light emitting elements, thereby narrowing a difference between an outer region and a central region of the liquid crystal display device.

As a result, it may be possible to enhance the brightness uniformity of the liquid crystal display device.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
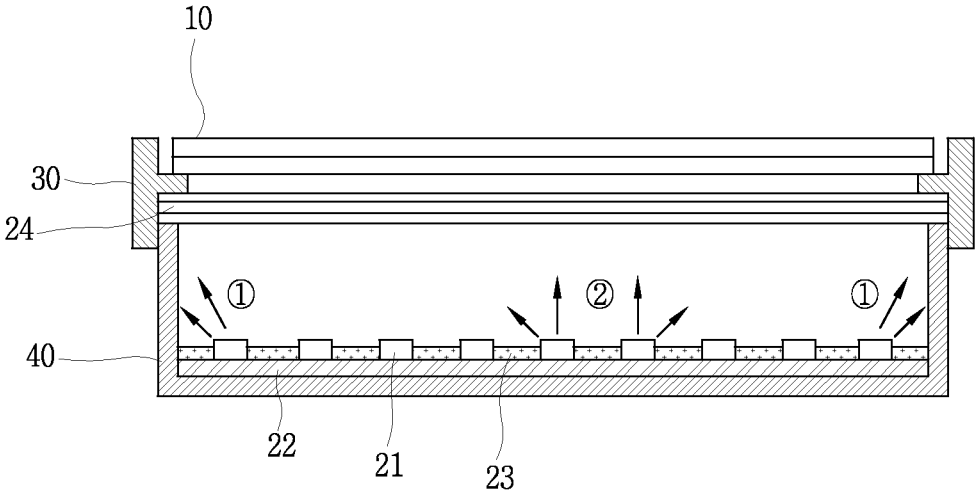
FIG. 1 RELATED ART
FIG. 1 is a cross-sectional view illustrating a direct type liquid crystal display device according to the related art.

Hereinafter, a liquid crystal display device and a method for fabricating the same according to an embodiment of the present invention will be described in more detail with reference to the accompanying drawings.

Even in different embodiments according to the present disclosure, the same or similar reference numerals are designated to the same or similar configurations, and the description thereof will be substituted by the earlier description.

Unless clearly used otherwise, expressions in the singular number used in the present disclosure may include a plural meaning.

Furthermore, for the sake of convenience of explanation, it should be taken into consideration that constituent elements in the accompanying drawings of the present disclosure may be illustrated in an enlarged or reduced manner.

In addition, the terms including an ordinal number such as first, second, etc. which are used in the present disclosure, can be used to describe various elements, but the elements should not be limited by those terms since the terms are used merely for the purpose to distinguish an element from the other element.

Figure 2:
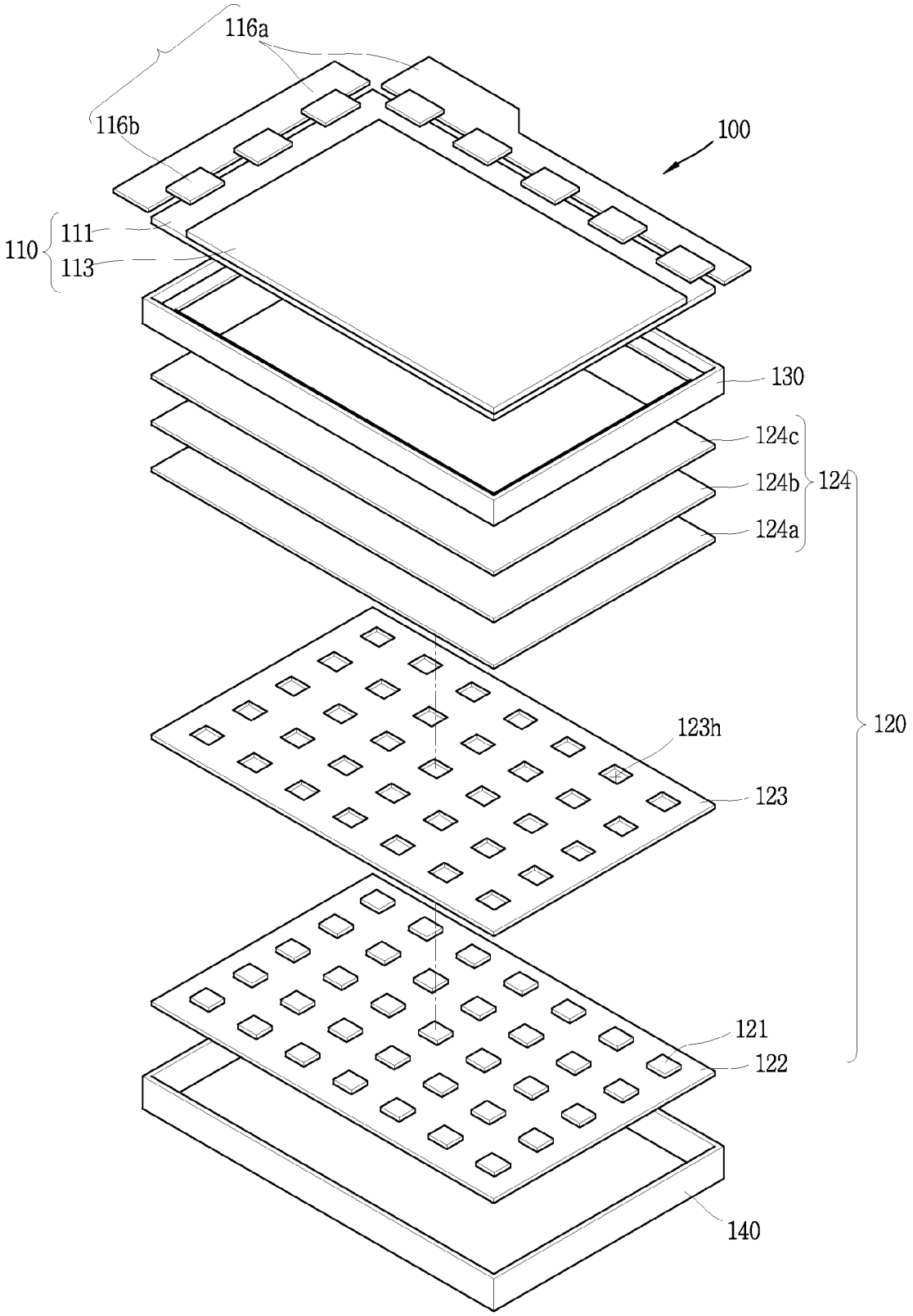
FIG. 2 is an exploded perspective view illustrating a direct type liquid crystal display device according to a first embodiment of the present disclosure.
Figure 3:
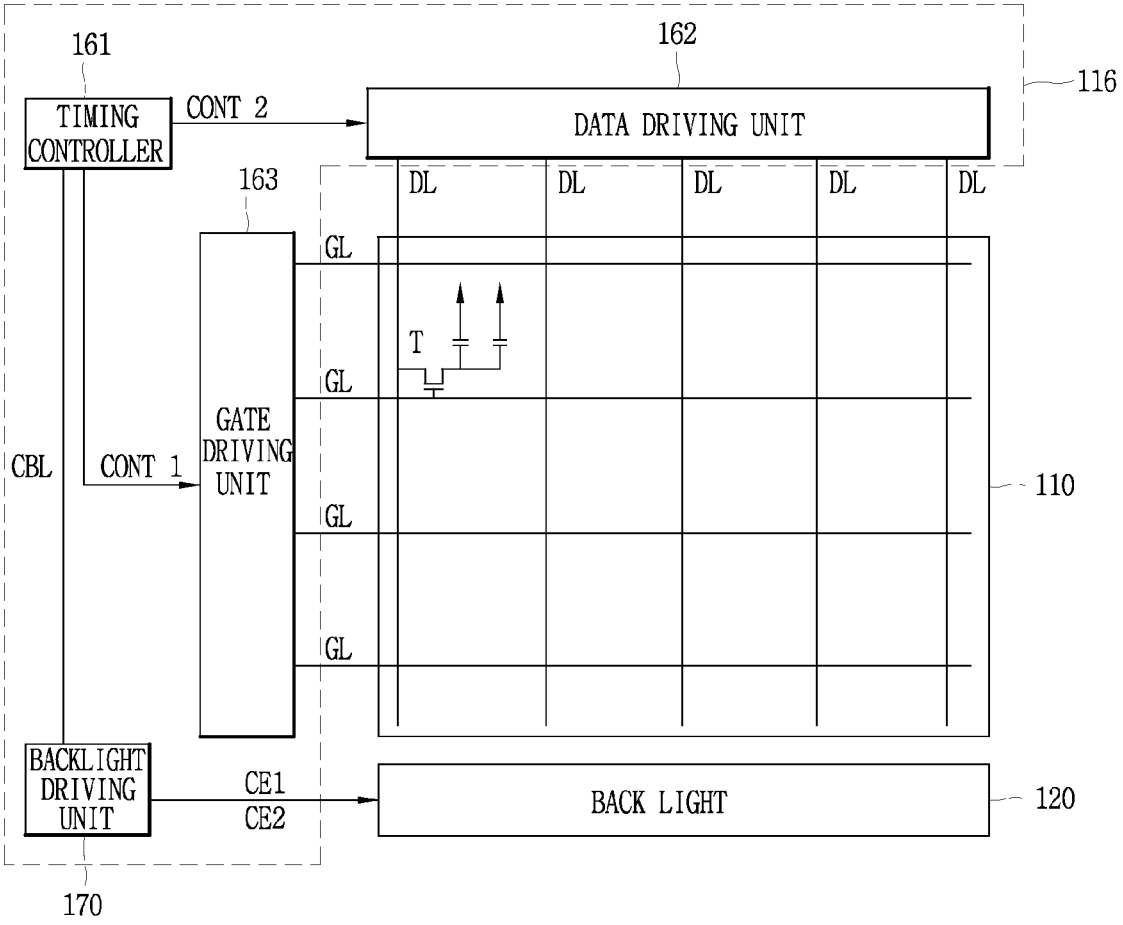
FIG. 3 is a block diagram illustrating a direct type liquid crystal display device according to a first embodiment of the present disclosure.

FIG. 2 is an exploded perspective view illustrating a direct type liquid crystal display device according to a first embodiment of the present disclosure, and FIG. 3 is a block diagram illustrating a direct type liquid crystal display device according to a first embodiment of the present disclosure.

A liquid crystal display device 100 according to a first embodiment of the present disclosure may include a liquid crystal panel 110 displayed with an image, a driving circuit unit 116 connected to one side of the liquid crystal panel 110 to drive the liquid crystal panel 110, and a backlight 120 disposed at a rear surface of the liquid crystal panel 110 to illuminate light to the liquid crystal panel 110.

The liquid crystal panel 110 is a portion of performing the key role of image representation, and comprised of a liquid crystal layer (not shown), a thin-film transistor (TFT) substrate 111 and a color filter substrate 113 adhered to each other by interposing the liquid crystal layer (not shown) therebetween.

Furthermore, the liquid crystal panel 110 is connected to a circuit board 116*a* by means of a connecting member 116*b* such as a flexible printed circuit board (FPCB) or tape carrier package (TCP) along at least one edge thereof. The circuit board 116*a* may generate a signal for controlling the liquid crystal panel 110 and backlight 120. The circuit board 116*a* may be properly bent and closely adhered to a lateral surface of the guide panel 130 or a rear surface of the cover bottom 140 during the modularization process.

Moreover, a gate driving unit and a data driving unit for receiving a signal of the circuit board 116*a* and driving the liquid crystal panel may be mounted on the connecting member 116*b*. However, the gate driving unit and data driving unit may be formed on one surface of the liquid crystal panel 110 in the form of a chip on glass (COG).

In addition, the guide panel 130 may surround a lower edge of the liquid crystal panel 110 to support and protect the liquid crystal panel 110, and the cover bottom 140 may accommodate the backlight 120 to be fastened to the guide panel 130.

Furthermore, the backlight 120 is located at a rear surface of the liquid crystal panel 110 to perform the role of supplying light to the liquid crystal panel. In order to supply light, the backlight 120 may include a plurality of light emitting elements 121, a printed circuit board (PCB) 122 for driving the plurality of light emitting elements 121, a reflective plate 123 for reflecting light, and a plurality of optical sheets 124 for diffusing and condensing light.

The plurality of light emitting elements 121 are an element for emitting light. The light emitting element may include a light emitting element using a fluorescent material or semiconductor light emitting element. Here, the semiconductor light emitting element may be a light emitting diode (LED). The LED is an element for illuminating light, and has advantages such as low power consumption and long life span.

The plurality of light emitting elements 121 may be arranged in a check pattern while being separated from one another by a predetermined distance. Furthermore, the plurality of light emitting elements 121 may be formed with emitting any one wavelength of blue, red, green or formed with emitting a white wavelength spectrum including all those wavelengths. Furthermore, the light emitting elements 121 may be mounted on a front surface of the printed circuit board 122 in a package form, and a single or plurality of LED(s) may be incorporated into one package.

Meanwhile, a lens (not shown) for condensing light may be disposed at an upper portion of the light emitting elements 121.

The printed circuit board 122 performs the role of mounting and operating the light emitting elements 121 at a rear surface of the light emitting elements 121. Accordingly, circuit wiring for driving the light emitting elements 121 is formed on a front surface thereof. Furthermore, the light emitting elements 121 generate a lot of heat while emitting light, and thus the printed circuit board 122 may be made of aluminium having an excellent heat transfer rate as a main material.

The reflective plate 123 is disposed at a front surface of the printed circuit board 122 to reflect light transmitted in the direction of the printed circuit board 122 but not in the direction of the optical sheet 124 within the backlight, thereby performing the role of reducing light loss. In FIG. 2, the reflective plate 123 is formed in a plane shape, but may be also formed in a protruded shape to cover an inner lateral surface of the cover bottom 140, thereby preventing light of the light emitting elements directed toward an inner lateral surface of the cover bottom 140 from being absorbed.

Furthermore, an arrangement region of the light emitting elements 121 should be open to dispose the reflective plate 123 at an upper portion of the printed circuit board 122, and thus a plurality of opening portions 123*h* may be formed thereon. The plurality of opening portions 123*h* are formed according to a shape of the disposed light emitting elements 121, and thus the reflective plate 123 has a shape arranged in a matrix pattern in FIG. 2.

The plurality of optical sheets 124 may include a diffuser sheet 124*a*, a prism sheet 124*b* and a protector sheet 124*c* which are sequentially stacked thereon. The diffuser sheet 124*a* may diffuse light to supply it to the liquid crystal panel 110, and the prism sheet 124*b* may allow light that has been transmitted through the diffuser sheet 124*a* to advance toward the liquid crystal panel 110 in the vertical direction to enhance brightness, and the protector sheet 124*c* may prevent foreign substances from being inserted into the prism sheet 124*b* and diffuser sheet 124*a* or scratches from being generated. At this time, the number of the diffuser sheets 124*a* and prism sheets 124*b* may not be limited and a reflective polarizer (dual brightness enhancement film, DBEF) (not shown) may be additionally disposed thereon. The reflective polarizer (not shown) reflects light that has not been transmitted through a lower polarizing plate of the liquid crystal panel 110 and reuses it as light being transmitted through the lower polarizing plate, thereby performing the role of enhancing brightness.

Hereinafter, a method of driving a direct type liquid crystal display device according to a first embodiment of the present disclosure will be described with reference to FIG. 3.

The driving circuit unit 116 may largely include a timing controller 161, a gate driving unit 163 and a data driving unit 162 for driving the liquid crystal panel 110, and a backlight driving unit 170 for driving the backlight 120.

The timing controller 161 receives a video signal and control signals for displaying the same, for example, vertical synchronization (Vsync), horizontal synchronization (Hsync), main clock (MCLK), data enable (DE) signal, and the like from an external controller (not shown). The timing controller 161 generates a gate control signal (CONT1), a data control signal (CONT2), a backlight control signal (CBL), and the like based on the provided control signals, and properly processes the video signal in accordance with the operation condition of the liquid crystal panel 110, and then provides the gate control signal (CONT1) to the gate driving unit 163 and provides the data control signal (CONT2) and the processed video signal to the data driving unit 162.

The gate driving unit 163 applies a gate-on voltage (Von) to the gate line (GL) according to the gate control signal (CONT1) to turn on a thin-film transistor (T) connected to the gate line (GL).

The data driving unit 162 sequentially receives a video signal corresponding to one row of the unit pixels according to the data control signal (CONT2), and selects a gray voltage corresponding to each video signal among the gray voltages to convert the video signal into the relevant data voltage. Then, the data driving unit 162 supplies each data voltage to the relevant data line (DL) to drive the relevant unit pixel through the turned-on thin-film transistor (T).

At this time, liquid crystal molecules changes the alignment according to a change of electric field generated by the pixel electrode and common electrode and accordingly the polarization of light passing through the liquid crystal layer is changed. Such a change of polarization is exhibited with a transmittance change of light by the polarizer (not shown) adhered to the TFT substrate and color filter substrate.

Furthermore, the backlight driving unit 170 receives a backlight control signal (CBL) and generates signals (CE1, CE2) for controlling the light emitting elements of the backlight 120 to drive the backlight 120. At this time, the backlight control signal (CBL) is received at the backlight driving unit 170 in the state of having a specific duty ratio, and the backlight driving unit 170 may adjust the brightness of the backlight 120 using a method of varying the duty ratio or voltage level of the signals (CE1, CE2) for controlling the light emitting elements according to the backlight control signal (CBL). Here, the backlight driving unit 170 may be divided into two or more regions to drive the light emitting elements, and at least one of the duty ratio and current level for controlling each light emitting element may be configured in a different manner.

Figure 4A:
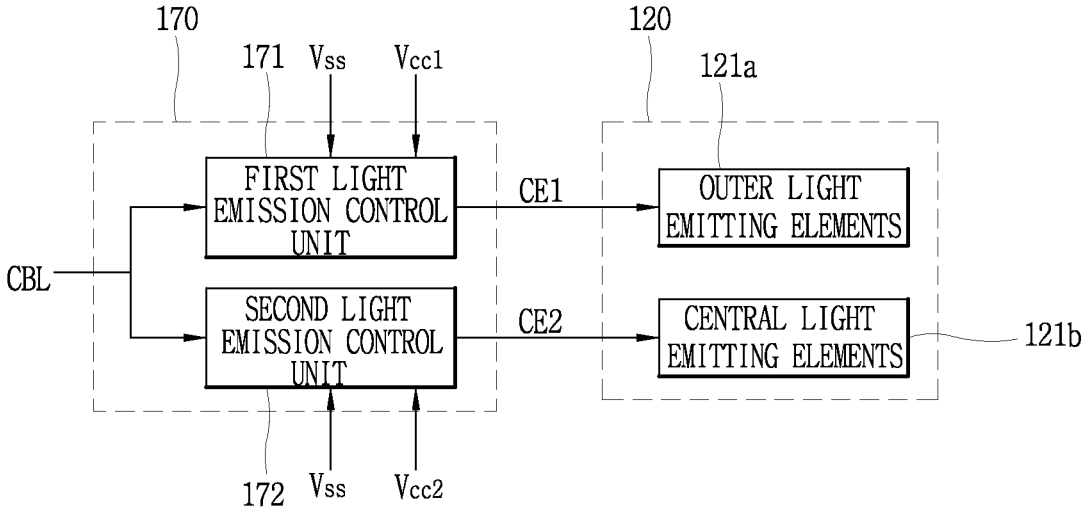
FIG. 4A is a block diagram illustrating a backlight driving unit and a backlight according to a first embodiment of the present disclosure.
Figure 4B:
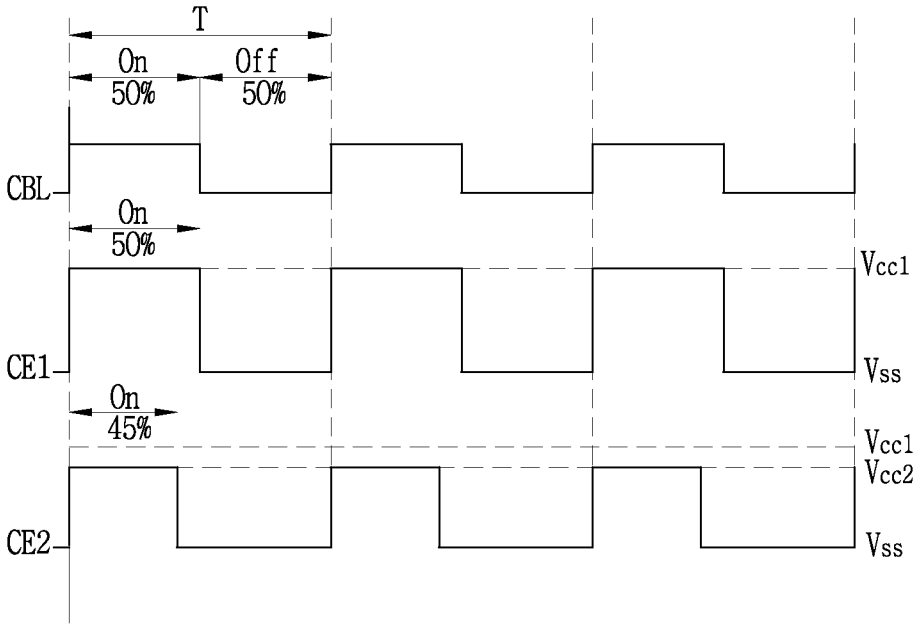
FIG. 4B is a graph illustrating a backlight control signal, a first light emission signal, and a second light emission signal according to a first embodiment of the present disclosure.
Figure 5:
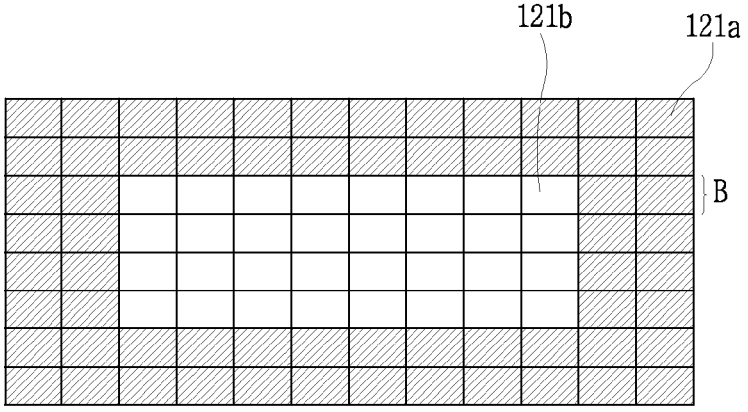
FIG. 5 is a schematic plan view illustrating a backlight according to a first embodiment of the present disclosure.
Figure 6:
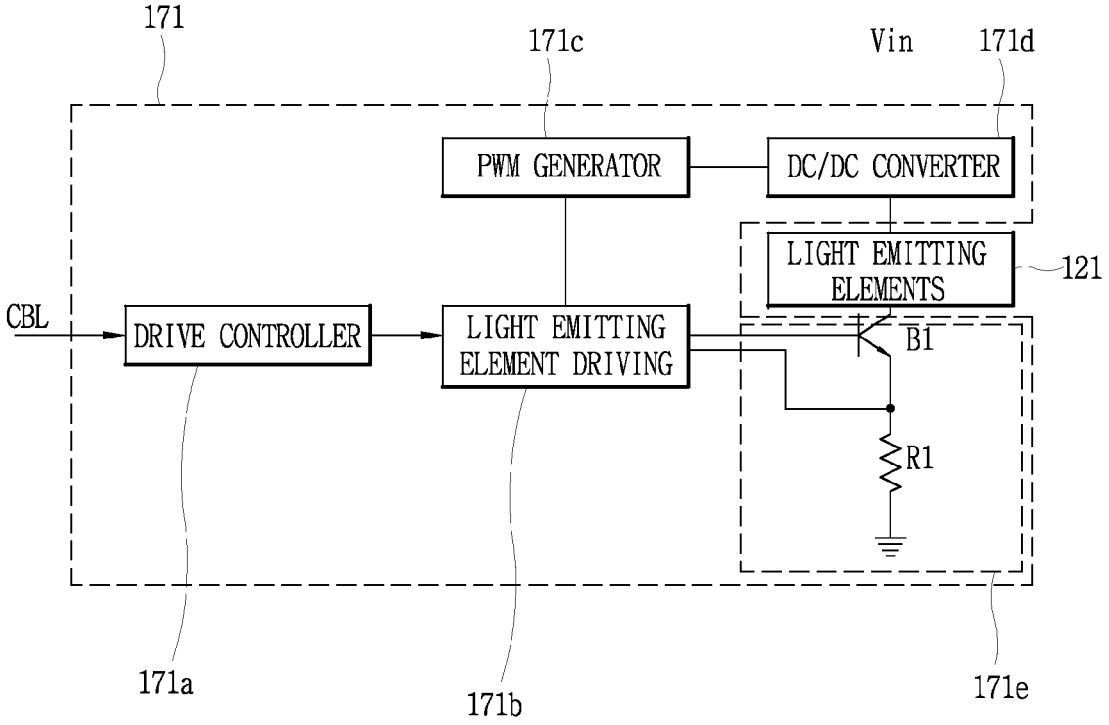
FIG. 6 is a block diagram illustrating a light emission control unit according to a first embodiment of the present disclosure.

Hereinafter, the backlight driving unit will be described in detail with reference to FIGS. 4A, 4B, 5 and 7. FIG. 4A is a block diagram illustrating a backlight driving unit and a backlight according to a first embodiment of the present disclosure, and FIG. 4B is a graph illustrating a backlight control signal, a first light emission signal, and a second light emission signal according to a first embodiment of the present disclosure, and FIG. 5 is a schematic plan view illustrating a backlight according to a first embodiment of the present disclosure, and FIG. 6 is a block diagram illustrating a light emission control unit according to a first embodiment of the present disclosure, and FIG. 7 is a flow chart illustrating a method of driving the backlight according to a first embodiment of the present disclosure.

First, referring to FIG. 4A, the backlight driving unit 170 may include a first light emission control unit 171 and a second light emission control unit 172, and the backlight 120 may include outer light emitting elements 121*a* and central light emitting elements 122*b*. The first light emission control unit 171 is provided to drive the outer light emitting elements 121*a*, and the second light emission control unit 172 is provided to drive the outer light emitting elements 121*a*. The outer light emitting elements 121*a* designates light emitting elements disposed by surrounding the central light emitting elements 122*b* disposed in a central region of the backlight 120.

Figure 7:
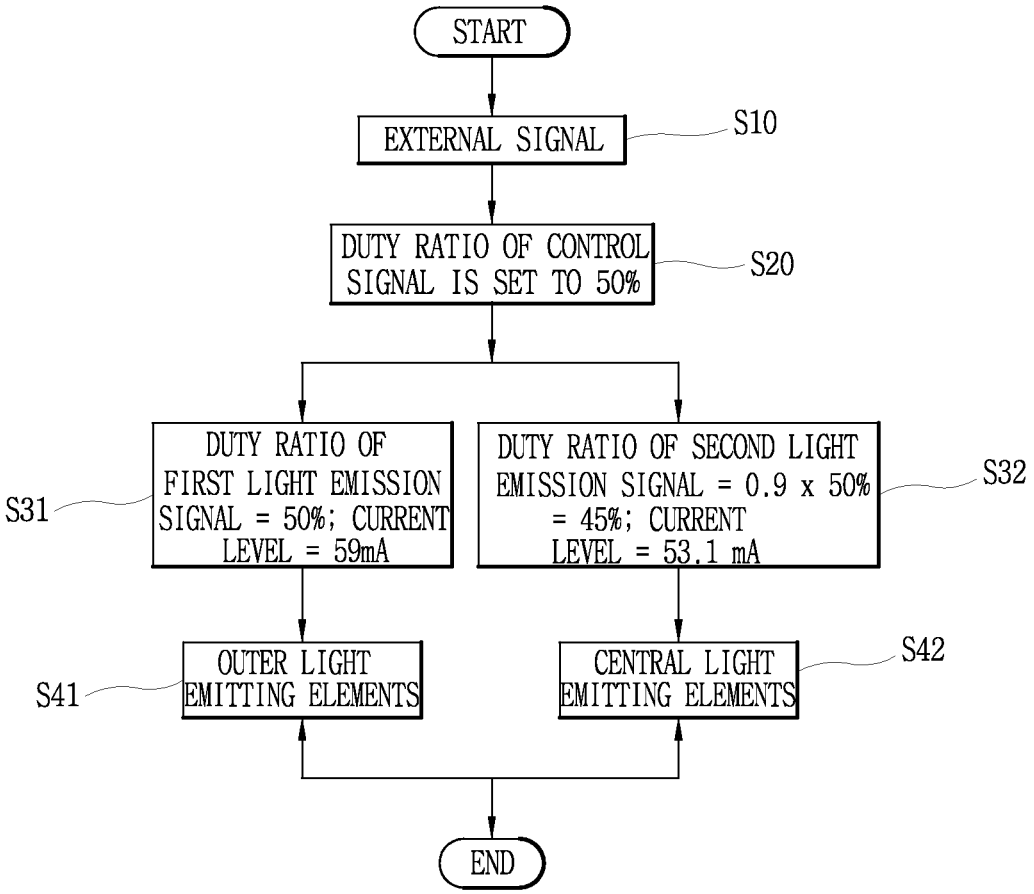
FIG. 7 is a flow chart illustrating a method of driving a backlight according to a first embodiment of the present disclosure.

[Steps S10, S20 in FIG. 7]

The first and the second light emission control unit 171, 172 receive a backlight control signal (CBL). Referring to FIG. 4B, the backlight control signal (CBL) may be a signal having a specific duty ratio. The duty ratio refers to a ratio of signal for turning on the light emission signal for one period (T). The duty ratio may become 50%, for example. At this time, the duty ratio varies in the range of 1-100% according to an external signal. Specifically, the user may enter a predetermined command signal for the purpose of adjusting the brightness of the liquid crystal display device, and the timing controller generates a backlight control signal (CBL) having a specific duty ratio according to the external data input, and the specific duty ratio may become 1-100%.

[Steps S31, S32 in FIG. 7]

Furthermore, the first light emission control unit 171 may generate a first light emission signal (CE1) as illustrated in FIG. 4B based on a lower driving voltage(Vss), a first high driving voltage(Vcc1) and the backlight control signal (CBL). The first light emission control unit 171 outputs a first high driving voltage (Vcc1) during a section in which the received backlight control signal (CBL) is on, and outputs a low driving voltage (Vss) during a section in which the received backlight control signal (CBL) is off to generate the first light emission signal (CE1).

As a result, the first light emission signal (CE1) may have the same duty ratio as that of the backlight control signal (CBL), and have a specific current level by a potential formed by the first high driving voltage (Vcc1) and low driving voltage (Vss). For example, the current level may be 59 mA.

The second light emission control unit 172 may generate a second light emission signal (CE2) as illustrated in FIG. 4B based on a lower driving voltage (Vss), a second high driving voltage (Vcc2) and the backlight control signal (CBL). The second light emission control unit 172 may have a voltage level less than that of the first high driving voltage (Vcc1). Furthermore, the second light emission control unit 172 outputs a second high driving voltage (Vcc2) during a section in which the backlight control signal (CBL) is on, and outputs it in such a manner that the duty ratio of the second light emission signal (CE2) is less than that of the backlight control signal (CBL). Then, the low driving voltage (Vss) is output immediately subsequent to completing the output of the second high driving voltage (Vcc2). As a result, the duty ratio of the second light emission signal (CE2) is configured to be less than that of the first light emission signal (CE1). For example, the duty ratio of the second light emission signal (CE2) may be 45%, which is a value less than that of the first light emission signal (CE1) by 10%. As a result, the second light emission signal (CE2) may be configured with a duty ratio or current level less than that of the first light emission signal (CE1). For example, the current level may be 53.1 mA.

[Steps S41, S42 in FIG. 7]

Furthermore, the first light emission signal (CE1) is applied to the outer light emitting elements 121*a*, and the second light emission signal (CE2) is applied to the central light emitting elements 121*b*. Accordingly, the turn-on section of the outer light emitting elements 121*a* may be longer than that of the central light emitting elements 121*b* by a difference of the duty ratio, and the emission intensity of the outer light emitting elements 121*a* may be greater than that of the central light emitting elements 121*b* by a difference of the current level. Accordingly, the brightness of the outer light emitting elements 121*a* may be greater than that of the cental emitting elements 121*b*.

Here, the operation of the first and the second light emission control unit will be described in detail with reference to FIG. 6. Though FIG. 6 illustrates only an internal configuration of the first and the second light emission control unit 170, the second light emission control unit may include the same configuration. The first light emission control unit 171 may include a drive controller 171*a*, a light emitting element driving unit 171*b*, a PWM generator 171*c*, a DC/DC converter 171*d*, and a duty ratio and current controller 171*e*.

The driving circuit unit 171*a* generates a signal for receiving the backlight control signal (CBL) to drive the light emitting element driving unit 171*b*. The SPI(Serial Peripheral Interface; SPI) scheme may be selected for a communication scheme between the drive controller 171*a* and the light emitting element driving unit 171*b*. At this time, the drive controller 171*a* may be referred to as MCU(Micro Controller Unit; MCU). The drive controller 171*a* may be configured with one circuit for controlling the first light emission control unit and second light emission control unit without being included in the first light emission control unit.

The light emitting element driving unit 171*b* drives the light emitting element 121 according to a command of the drive controller 171*a*. The light emitting element driving unit 171*b* may be referred to as a LED driver IC, and configured with a plurality of ICs. Here, according to the light emitting element driving scheme, the PWM generator 171*c* may be controlled to allow the DC/DC converter 171*d* to output a first light emission signal having a specific voltage level, and a switching element (B1) connected to the light emitting element 121 is turned on or turned off to allow the first light emission signal to have a specific duty ratio.

The PWM generator 171*c* generates a predetermined pulse shaped signal to perform the role of controlling the DC/DC converter 171*d*.

The DC/DC converter 171*d* outputs a first light emission signal having a specific level of voltage through an input voltage. For example, the specific level of voltage may be a difference value between the low driving voltage (Vss) and the first high driving voltage (Vcc1) illustrated in FIGS. 4A and 4B. Here, the light emitting element driving unit 171*b* is connected to the PWM generator 171*c* and DC/DC converter 171*d*, and thus the voltage level of the first light emission signal may be compensated by a feedback.

Here, the duty ratio and current controller 171*e* may include a switching element (B1) and a resistor (R1) to perform the key role of determining the duty ratio and current of the first light emission signal.

The switching element (B1) may be comprised of a BJT (Bipolar Junction Transistor; BJT), and the base terminal thereof is connected to the light emitting element driving unit 171*b*, and the emitter terminal thereof is connected to the resistor (R1), and the collector terminal thereof is connected to the light emitting element 121. The switching element (B1) may be turned on or turned off according to the control of the light emitting element driving unit 171*b*. When the switching element (B1) is turned on, the light emitting element 121 is operated to emit light, but when turned off, the light emitting element 121 does not emit light. In other words, the duty ratio of the first light emission signal is determined according to a period of time for which the switching element (B1) is turned on within one cycle of the first light emission signal. At this time, the light emitting element driving unit 171*b* may control the switching element (B1) to allow the first light emission signal to have the same duty ratio as that of the backlight control signal (CBL).

Furthermore, the resistor (R1) is connected in series to the light emitting element 121 to be a factor capable of determining a current applied to the light emitting element 121, and thus the current level of the first light emission signal may be determined according to the resistor (R1). In addition, the resistor (R1) has a fixed value, thereby allowing the current to be operated at a predetermined level.

In case of the second light emission control unit, the drive controller 171*a* receives the backlight control signal (CBL) and controls the light emitting element driving unit 171*b* to output a second light emission signal corresponding to 90% of the duty ratio of the backlight control signal (CBL). Here, the light emitting element driving unit 171*b* controls the operation of the switching element (B1), and the second light emission signal is configured to be less than that of the first light emission signal by 10%.

In this case, the light emitting element driving unit 171*b* may be configured with a plurality of units, and a plurality of light emitting elements 121 may be connected to one light emitting element driving unit 171*b*. Here, the duty ratio control is carried out by the switching element (B1), and the light emitting element driving unit 171*b* can drive a plurality of switching elements (B1) in a different manner, and thus a different duty ratio may be applicable to light emitting elements 121, respectively. However, the current level control is determined by the resistor (R1), voltage, and an internal resistor of the light emitting element 121, and thus a different current level can be applied to each light emitting element driving unit 171*b*, and the same current level can be applied to a plurality of light emitting elements 121 connected to one light emitting element driving unit 171*b*.

On the other hand, in order to induce a brightness difference between the outer light emitting elements 121*a* and central light emitting elements 121*b*, it may be sufficient that only one of the duty ratio and current level has different values, and thus the first embodiment of the present disclosure may include both the foregoing case and a case where at least one of the duty ratio and current level of the outer light emitting elements 121*a* is greater than the corresponding duty ratio or current level of the central light emitting elements 121*b*.

In addition, in connection with the duty ratio, when the duty ratio of the first light emission signal (CE1) is greater than that of the second light emission signal (CE2), the first embodiment of the present disclosure may include a case where the duty ratio of the first light emission signal (CE1) is less than or greater than that of the backlight control signal (CBL).

Furthermore, in connection with the current level, as a method of varying the current level there has been described a method of configuring the voltage level of the first and the second light emission signal (CE1, CE2) in a different manner for the method of varying the current level, but it may not necessarily limited to this. The first embodiment of the present disclosure may include a case where the size of the constant current is configured in a different manner while driving the outer light emitting elements 121*a* and central light emitting elements 121*b* with the constant current source or a case where the resistor of the outer light emitting elements 121*a* is differently configured from that of the central light emitting elements 121*b*.

Here, the plurality of light emitting elements may be controlled in the unit of block (B), and the block (B) may include a predetermined number of light emitting elements. The outer light emitting elements 121*a* and central light emitting elements 121*b* divided on the basis of the block (B) are illustrated in FIG. 5.

Referring to FIG. 5, a plurality of blocks (B) surrounding the rim with two columns are outer light emitting elements 121*a*, and inner light emitting elements surrounded by the outer light emitting elements 121*a* are central light emitting elements 121*b*.

Here, a direct type liquid crystal display device according to a first embodiment of the present disclosure may not limited to the number of blocks illustrated in FIG. 5, and may be also divided into a number of blocks (B) that is greater than or less than the number. Furthermore, the range of the blocks (B) included in the outer light emitting elements 121*a* may be configured with only one column or more than two columns contrary to FIG. 5. At this time, the range of the blocks (B) included in the central light emitting elements 121*b* may be formed in a different manner according to the range of the blocks (B) included in the outer light emitting elements 121*a*.

When the first and the second light emission signal (CE1, CE2) are applied to the outer light emitting elements 121*a* and central light emitting elements 121*b* arranged in such a pattern, the brightness of the outer light emitting elements 121*a* may be higher than that of the central light emitting elements 121*b*. However, light absorption phenomenon may occur due to an inner lateral surface of the cover bottom or other external factors at an outer portion of the light emitting region and thus have a relatively reduced brightness than the central portion of the light emitting region. Accordingly, the brightness of light emitted from the light emitting elements and observed on a surface of the backlight 120 or on a surface of the liquid crystal display device may be uniformly measured over the entire surface thereof. In other words, according to a first embodiment of the present disclosure, the backlight 120 may be driven such that the brightness of the outer light emitting elements 121*a* is higher than that of the central light emitting elements 121*b*, thereby enhancing brightness uniformity.

Such an effect will be described in detail with reference to FIGS. 8A and 8B.

Figures 8A, 8B:
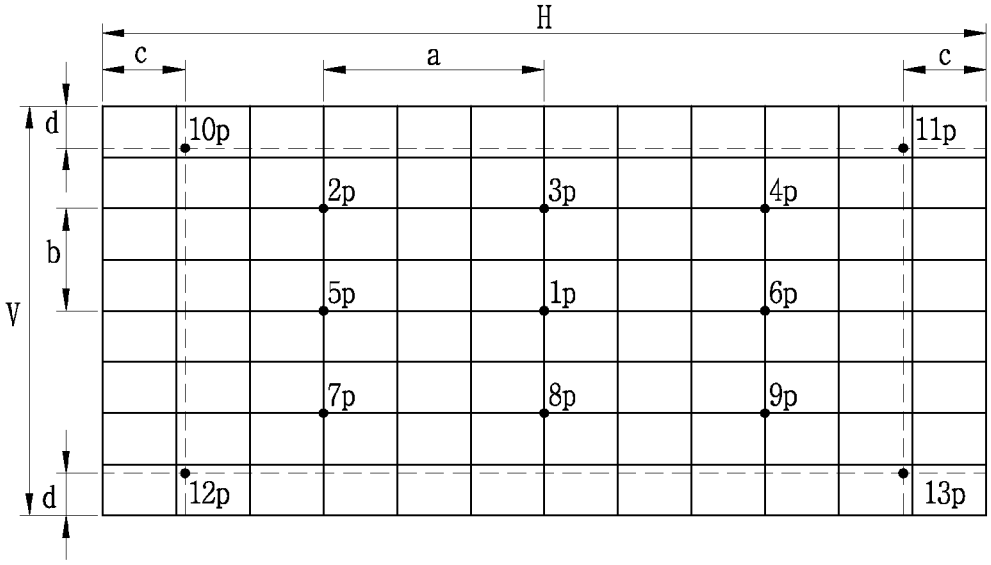
FIG. 8A is a plan view illustrating a backlight according to a first embodiment of the present disclosure.
FIG. 8B is a table in which brightness in the related art is compared with that in the first embodiment.

FIG. 8A is a plan view illustrating a backlight according to a first embodiment of the present disclosure, and FIG. 8B is a table in which brightness in the related art is compared with that in the first embodiment.

Brightness measurement points are illustrated in FIG. 8A. The first through the ninth points are placed at a horizontal interval of "a" and a vertical interval of "b". Here, "a" is a value of h/4 and "b" is a value of v/4. Furthermore, the first point is disposed at the very center thereof. Meanwhile, the 10th through the 13th points are disposed at the outer portion and placed horizontally with a distance "c" from the edge and vertically with a distance "d" from the edge. At this time, "c" is a value of h/12, and "d" is a value of v/12.

The result of measuring brightness at the location of the first through the 13th points is illustrated in FIG. 8B.

First, comparing the first embodiment of the present disclosure with the related art for the first through the 9th points, the brightness in the first embodiment of the present disclosure was measured less than that of the other.

Then, comparing the first embodiment of the present disclosure with the related art for the 10th through the 13th points, the brightness in the first embodiment of the present disclosure was measured greater than that of the other.

As a result, comparing the first embodiment of the present disclosure with the related art for the brightness uniformity, it is seen that values in the first embodiment of the present disclosure were measured less than that of the other. The brightness uniformity is a value of the largest brightness value divided by the smallest brightness value among the first through the 13th points. Accordingly, it can be said that the brightness uniformity characteristic is better when the value is measured to be lower.

In other words, the effect in the first embodiment of the present disclosure has a significant meaning in achieving an enhanced brightness uniformity compared to the related art without increasing additional cost only by using a different method of driving light emitting elements to solve a brightness uniformity deterioration phenomenon caused by the structural characteristic of a direct type liquid crystal display device.

Hereinafter, a second embodiment of the present disclosure will be described in detail with reference to other drawings.

Figure 9:
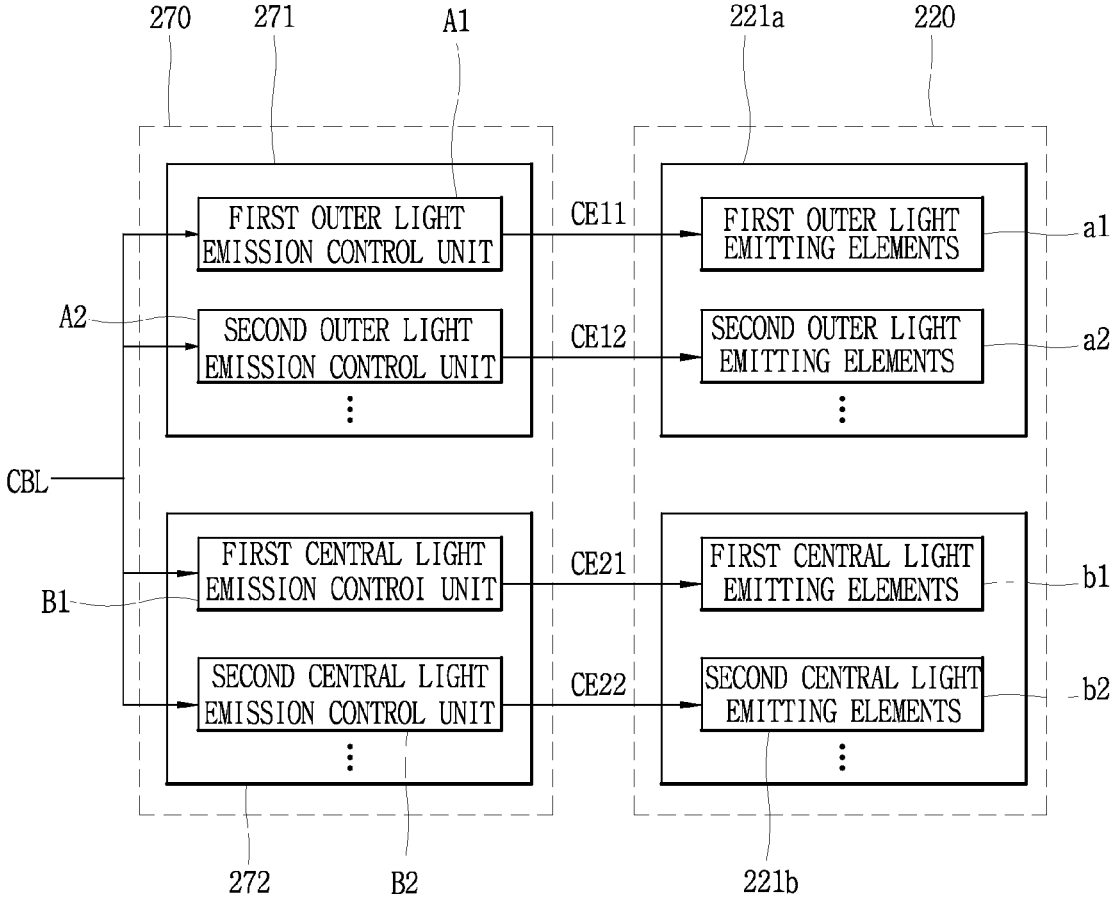
FIG. 9 is a block diagram illustrating a backlight driving unit and a backlight according to a second embodiment of the present disclosure.
Figure 10:
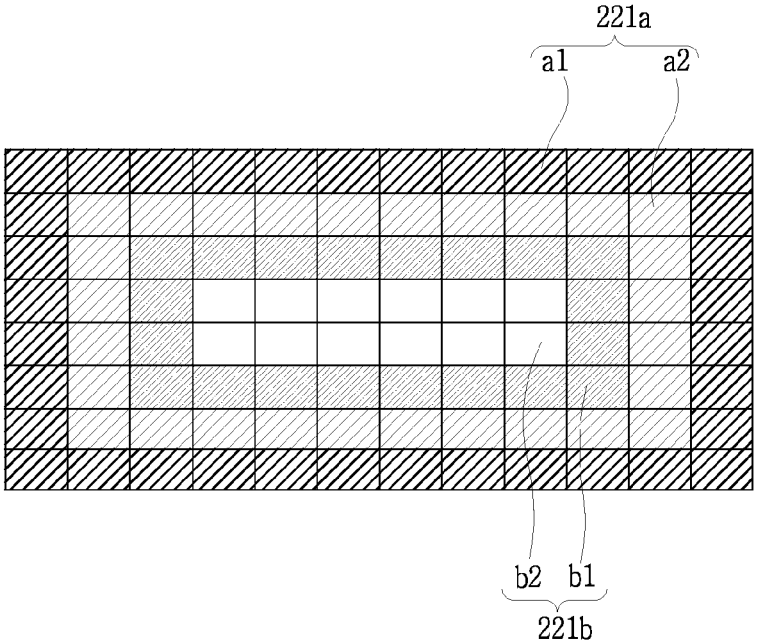
FIG. 10 is a schematic plan view illustrating a backlight according to a second embodiment of the present disclosure.

FIG. 9 is a block diagram illustrating a backlight driving unit and a backlight according to a second embodiment of the present disclosure, and FIG. 10 is a schematic plan view illustrating a backlight according to a second embodiment of the present disclosure.

According to a second embodiment of the present disclosure, the outer light emitting elements 221*a* and central light emitting elements 221*b* may be divided into a plurality of groups to drive at least one of the duty ratio and current level of the light emitting elements for each group with a different value.

Accordingly, the configuration and driving method other than the foregoing driving method are similar to the description of the first embodiment and thus the description thereof will be substituted by that of the first embodiment.

The backlight 220 driving unit according to a second embodiment may include a first light emission control unit 271 and a second light emission control unit 272, and the backlight 220 may include outer light emitting elements 221 a and central light emitting elements 221*b*. Here, the first light emission control unit 271 may include a plurality of outer light emission control units (A1, A2 . . . ), and the second light emission control unit 272 may include a plurality of central light emission control units (B1, B2 . . . ). Furthermore, the outer light emitting elements 221*a* and central light emitting elements 221*b* may include a plurality of light emitting elements (a1, a2, b1, b2).

When a backlight control signal (CBL) having a specific duty ratio is received at the backlight driving unit 270, the outer light emission control units and central light emission control units, respectively, receive a backlight control signal (CBL). At this time, at least one of the duty ratio or current level of the outer light emission control units and central light emission control units, respectively, is configured in a different manner. Furthermore, the duty ratio or current level configured in a different manner may be configured to have a sequentially increasing or decreasing value.

For example, assuming that the first light emission control unit 271 includes the first and the second outer light emission control unit (A1, A2) and the second light emission control unit 272 includes the first and the second central light emission control unit (B1, B2), the first outer light emission control unit (A1) may output a first outer light emission signal (CE11) having the highest duty ratio. In addition, the second outer light emission control unit (A2), first central light emission control unit (B1) and second light emission control unit (B2) may output a second outer light emission signal (CE12), a first central light emission signal (CE21), and a second central light emission signal (CE22), respectively, and the duty ratio of the light emission signals (CE12, CE21, CE22) may be sequentially decreased. At this time, the duty ratio of each light emission signal may be configured on the basis of a duty ratio of the backlight control signal (CBL). It may be also applicable in a similar manner to the current level. However, the current level does not depends on the current level of the backlight control signal (CBL) but is fixed. In other words, the current level is a preset value.

The first outer light emission signal (CE11) may be applied to the first outer light emitting elements (a1), the second outer light emission signal (CE12) to the second outer light emitting elements (a2), the first central light emission signal (CE21) to the first central light emitting elements (b1), and the second central light emission signal (CE22) to the second central light emitting elements (b2).

The light emitting elements may be divided and disposed in a rim shape from the outer edge of the backlight 220 as illustrated in FIG. 10. Here, light emitting elements, respectively, may be driven in the unit of block containing a predetermined number of light emitting elements. For example, the first outer light emitting elements (a1) may be configured with one column of block surrounding the outermost edge, the second outer light emitting elements (a2) with one column of block disposed within the first outer light emitting elements (a1), the first central light emitting elements (b1) with one column of block disposed within the second outer light emitting elements (a2), and the second central light emitting elements (b2) with one column of block disposed within the first central light emitting elements (b1).

Accordingly, as located from the outermost to the central zone, light emission signals at least one of the duty ratio and current level of which is gradually decreased are applied to the backlight 220. For example, the duty ratio of the first outer light emitting elements (a1) may be 50%, and the duty ratio of the second outer light emitting elements (a2) may be 49%, and the duty ratio of the first central light emitting elements (b1) may be 48%, and the duty ratio of the second central light emitting elements (b2) may be 47%. Accordingly, the differential arrangement of brightness may be further subdivided compared to a case of the first embodiment, thereby further enhancing brightness uniformity.

On the other hand, the second embodiment of the present disclosure may not be limited to the foregoing example, and may include a case where they are divided into a plurality of light emitting elements such that only either one of the outer light emitting elements and central light emitting element has a different duty ratio or current level.

On still another hand, the third embodiment of the present disclosure may include a brightness measurement unit and a brightness change sensing unit, and thus blocks with a reduced brightness may be configured and driven in a variable manner, thereby increasing brightness uniformity.

The brightness measurement unit may be disposed at a front surface of the backlight or at a front surface or lower surface of the liquid crystal panel to measure the brightness of the backlight partitioned into a plurality of blocks. At this time, the brightness change sensing unit may receive all the measured brightness values and indicate blocks having a relatively low or high brightness. Then, the bright change sensing unit transmits a signal including the location information of blocks having a relatively low brightness to the first light emission control unit, and a signal including the location information of blocks having a relatively high brightness and information for compensating the brightness to the second light emission control unit. Subsequently, the first light emission control unit outputs a first light emission signal to the blocks having a low brightness, and the second light emission control unit outputs a second light emission signal having a duty ratio or current level lower than that of the first light emission signal to the blocks having a high brightness.

According to the foregoing third embodiment, it is operated all the time to compensate a brightness difference during the operation of the liquid crystal display device, thereby obtaining uniform brightness without additional maintenance or compensation by the manufacturer even when the brightness is changed by external factors.

Although the preferred embodiments of the present invention have been described in detail, it should be understood by those skilled in the art that various modifications and other equivalent embodiments thereof can be made.

Consequently, the rights scope of the present invention is not limited to the embodiments and various modifications and improvements thereto made by those skilled in the art using the basic concept of the present invention as defined in the accompanying claims will fall in the rights scope of the invention.

What is claimed is:

1. A liquid crystal display device with a direct type backlight, comprising:

a liquid crystal panel configured to display an image;

a direct type backlight comprises a plurality of light emitting elements, which are divided into central light emitting elements and outer light emitting elements surrounding the central light emitting elements;

a timing controller configured to generate a backlight control signal for controlling the plurality of light emitting elements based on a received external signal, the backlight control signal having a duty ratio; and a backlight driving circuit configured to generate a first light emission signal for driving the outer light emitting elements and a second light emission signal for driving the central light emitting elements according to the backlight control signal, wherein at least one of the duty ratio and a current level of the first light emission signal is configured to be greater than the corresponding duty ratio or current level of the second light emission signal, wherein the backlight driving circuit comprises:

a first light emission control circuit for generating the first light emission signal based on a first high driving voltage and a low driving voltage, the first light emission signal having the same duty ratio as the duty ratio of the backlight control signal; and a second light emission control circuit for generating the second light emission signal based on a second high driving voltage and the low driving voltage, the second light emission signal having a duty ratio lower than the duty ratio of the backlight control signal, wherein the first light emission control circuit and the second light emission control circuit simultaneously apply the first light emission signal and the second light emission signal to the outer light emitting elements and the central light emitting elements, respectively.

2. The liquid crystal display device of claim 1, wherein the duty ratio of the backlight control signal is set based on the received external signal.

3. The liquid crystal display device of claim 1, wherein the backlight driving circuit determines the respective duty ratios of the first and second light emission signals based on the duty ratio of the backlight control signal.

4. The liquid crystal display device of claim 1, wherein the backlight driving circuit determines respective current levels of the first and second light emission signals through a preset value.

5. The liquid crystal display device of claim 1, wherein the first and second light emission control circuits adjust the duty ratio of the respective one of the first and second light emission signals by controlling the on/off of a switching element connected to the corresponding light emitting elements.

6. The liquid crystal display device of claim 1, wherein the first and second light emission control circuits each comprise a DC/DC converter connected to an end of the corresponding light emitting elements to output a light emission signal having a specific level of voltage, a switching element connected to the other end of the corresponding light emitting elements, a resistor connected between the switching element and the ground terminal, a light emitting element driving circuit configured to control the on/off of the switching element to adjust the duty ratio of the respective one of the first and second light emission signal and control the DC/DC converter to adjust a voltage of the respective one of the light emission signal, and a drive controller configured to receive the backlight control signal to control the operation of the light emitting element driving circuit.

7. The direct type liquid crystal display device of claim 1, wherein the duty ratio of at least one of the first and second light emission signal is set to a different value for each corresponding light emitting element.

8. The liquid crystal display device of claim 7, wherein the current level of each of the first and second light emission signals is set to the same value for the corresponding light emitting elements.

9. The liquid crystal display device of claim 1, wherein the plurality of light emitting elements are defined as a plurality of blocks containing at least one light emitting element for each block, and driven in the unit of block.

10. The liquid crystal display device of claim 1, wherein each of the first and the second light emission signals comprises a plurality of signals, and the plurality of signals are applied to reduce at least one of the duty ratio and current level of the plurality of signals progressively from outermost light emitting elements of the direct type backlight to the central light emitting elements thereof.

11. The liquid crystal display device of claim 10, wherein the outer light emitting elements are disposed in a light emitting element region having a rim shape surrounding the central light emitting elements disposed at a central region of the direct type backlight.

12. The liquid crystal display device of claim 1, wherein the current level of the second light emission signal is lower than the current level of the first light emission signal.

13. A method of driving a liquid crystal display device with a direct type backlight comprising a liquid crystal panel configured to display an image and a direct type backlight containing a plurality of light emitting elements, which are divided into central light emitting elements and outer light emitting elements surrounding the central light emitting elements, the method comprising:

generating a backlight control signal having a specific duty ratio based on a received external signal;

generating first and second light emission signals each having a duty ratio which is set according to the backlight control signal and a current level which is set according to a preset value; and applying the first light emission signal to the outer light emitting elements and applying the second light emission signal to the central light emitting elements, wherein at least one of the duty ratio and current level of the first light emission signal is configured to be greater than the corresponding duty ratio or current level of the second light emission signal, wherein said generating the first and second light emission signals includes setting the duty ratio of the first light emission signal to be the same as the duty ratio of the backlight control signal, and setting the duty ratio of the second light emission signal to be lower that the duty ration of the backlight control signal, wherein said generating the first and second light emission signals includes setting the current level of the first light emission signal to be greater that the current level of the second light emission signal, wherein the first light emission signal is generated based on a first high driving voltage and a low driving voltage, and the second light emission signal is generated based on a second high driving voltage and the low driving voltage, wherein the first light emission signal and the second light emission signal are simultaneously applied to the outer light emitting elements and the central light emitting elements, respectively.

14. The method of claim 13, wherein said generating the first and second light emission signals controls the on/off of a switching element connected to the light emitting element to adjust the duty ratio of each of the first and second light emission signals.

15. The method of claim 13, wherein the duty ratio of the backlight control signal is set based on the received external signal.

16. The method of claim 13, wherein each of the first and second light emission signals comprises a plurality of signals that are applied to reduce at least one of the duty ratio and current level of the plurality of signals progressively from the outermost light emitting elements of the direct type backlight to the central light emitting elements thereof.

17. The method of claim 16, wherein the outer light emitting elements are disposed in a light emitting element region having a rim shape surrounding the central light emitting elements disposed at a central region of the direct type backlight.

* * * * *